United States Patent [19]

Stettler

[11] Patent Number: 4,796,771

[45] Date of Patent: Jan. 10, 1989

[54] SECURITY CLOSURE LID AND CONTAINER PROVIDED WITH SUCH LID

[76] Inventor: Friedrich Stettler, Hauptstr. 116, 8264 Eschenz, Switzerland

[21] Appl. No.: 143,316

[22] Filed: Jan. 11, 1988

Related U.S. Application Data

[63] Continuation of Ser. No. 887,241, Jul. 18, 1986, abandoned.

[30] Foreign Application Priority Data

Jul. 18, 1985 [CH] Switzerland ..... 3117/85
Jun. 25, 1986 [CH] Switzerland ..... 2550/86

[51] Int. Cl.[4] ..... B65D 41/48
[52] U.S. Cl. ..... 215/253
[58] Field of Search ..... 215/253, 256; 220/270, 220/276

[56] References Cited

U.S. PATENT DOCUMENTS 4,305,517 12/1981 Dennis ..... 215/256
4,331,248 5/1982 Jamer ..... 215/256

FOREIGN PATENT DOCUMENTS 381549 10/1964 Switzerland .
1218156 1/1971 United Kingdom ..... 220/270
1265477 3/1972 United Kingdom ..... 215/256

*Primary Examiner*—Donald F. Norton
*Attorney, Agent, or Firm*—Ostrolenk, Faber, Gerb & Soffen

[57] ABSTRACT

A security closure lid for containers having a flange-like mouth region which is intended to be gripped by a lid is taught. Briefly stated, a security closure lid has connected thereto a security closure band tearably connected with the lid. The lid is adapted to be pushed onto the flange-like mouth region of the container after filling of the container. The closure band is beveled so that it may not be removed from the flange-like mouth region without being separated or torn from the lid. This therefore reveals any damage, tampering or the like by a quick visual examination thereof.

11 Claims, 3 Drawing Sheets

SECURITY CLOSURE LID AND CONTAINER PROVIDED WITH SUCH LID

This is a continuation of Application Ser. No. 887,241 filed on July 18, 1986, now abandoned.

BACKGROUND OF THE INVENTION

This invention relates, generally, to a security or tamper-proof closure lid for containers and more particularly to a security container having a flange-like mouth region intended to be gripped by the lid and having a security band which is only removable by tearing from the lid and which will readily indicate any tampering prior to opening of the container.

It is becoming increasingly necessary and customary to provide certain types of containers such as foodstuffs and drug packages with security closures. The purpose of these closures is to ensure that after leaving the place of manufacture, access to the contents of the package cannot be had without detaching a security seal.

However, in the case of shaker dispensable products such as is used with spices and the like, there is difficulty in applying the security seal to the container. This is particularly so in a fully automated process where after filling, a lid is applied along with an attempt, in the same operation, to apply a security closure thereto.

Previous security closures have been known which are adapted to be applied to a container having a neck-like mouth. There, the neck is generally provided with a hook-shaped bead with tapers towards the container mouth. the closure has a sleeve adapted to be pushed over the outside of the neck and has a weakened portion which extends circumferentially therearound. In this way, the free end which is intended to grip behind the bead, can be torn off from the rest of the sleeve. The tearable end of the sleeve has a tear tab and a helical, weakened portion serving as a tear line which extends over at least one quarter of the circumference. This design therefore makes it possible during assembly, by suitable outward bending of the part over the sleeve, to lift it over the tapered bead towards the mouth without damage to the elastic material closure. Such bending is possible due to a notch in the weakening line which permits rotation of the tearable part by approximately sixty degrees. However, if the security closure does not consist of elastic material, then it is not possible to push it onto the container without subsequent deformation of the closure by rolling it inward or the like.

Closures of this type however no longer satisfy present-day requirements or those which may be reasonably anticipated as necessary since a security closure which has been even slightly torn or distorted is unacceptable. Further, present requirements dictate that tampering must be visible to the consumer prior to opening of the package.

SUMMARY OF THE INVENTION

It is therefore an object of the present invention to provide a closure lid with a security band in which even the smallest amount of damage, due to attempts to lift the cover off, may be easily spotted by the consumer or any supervisory agency.

It is a further object of the present invention to provide a security closure lid which is particularly usable for shaker-dispensable products such as spices.

It is still a further object of the present invention to provide a security closure lid of such a nature that it can be applied to the container together with the security closure in one operation and whereby, after removal of the security closure, the lid may itself be lifted off and the container be again closed for normal use.

It is yet another object of the present invention to provide a security closure lid for containers or the like, comprising a container having an opening at one end thereof, a flange portion integral with the one end of the container, a lid disposable on the flange portion, and a security band pivotally connected to the lid. The security band is separable from the lid at the pivot connection, such that upon placement of the lid onto the flange portion, the security band is permitted to pivot in a first direction with respect to the flange and such that attempted removal of the lid causes the security band to pivot in a second direction to thereby cause the security band to at least partially separate from the lid to indicate attempted removal.

BRIEF DESCRIPTION OF THE DRAWINGS

Reference may be now had in the accompanying drawings, in which.

DESCRIPTION OF THE PREFERRED EMBODIMENTS

Figure 1:
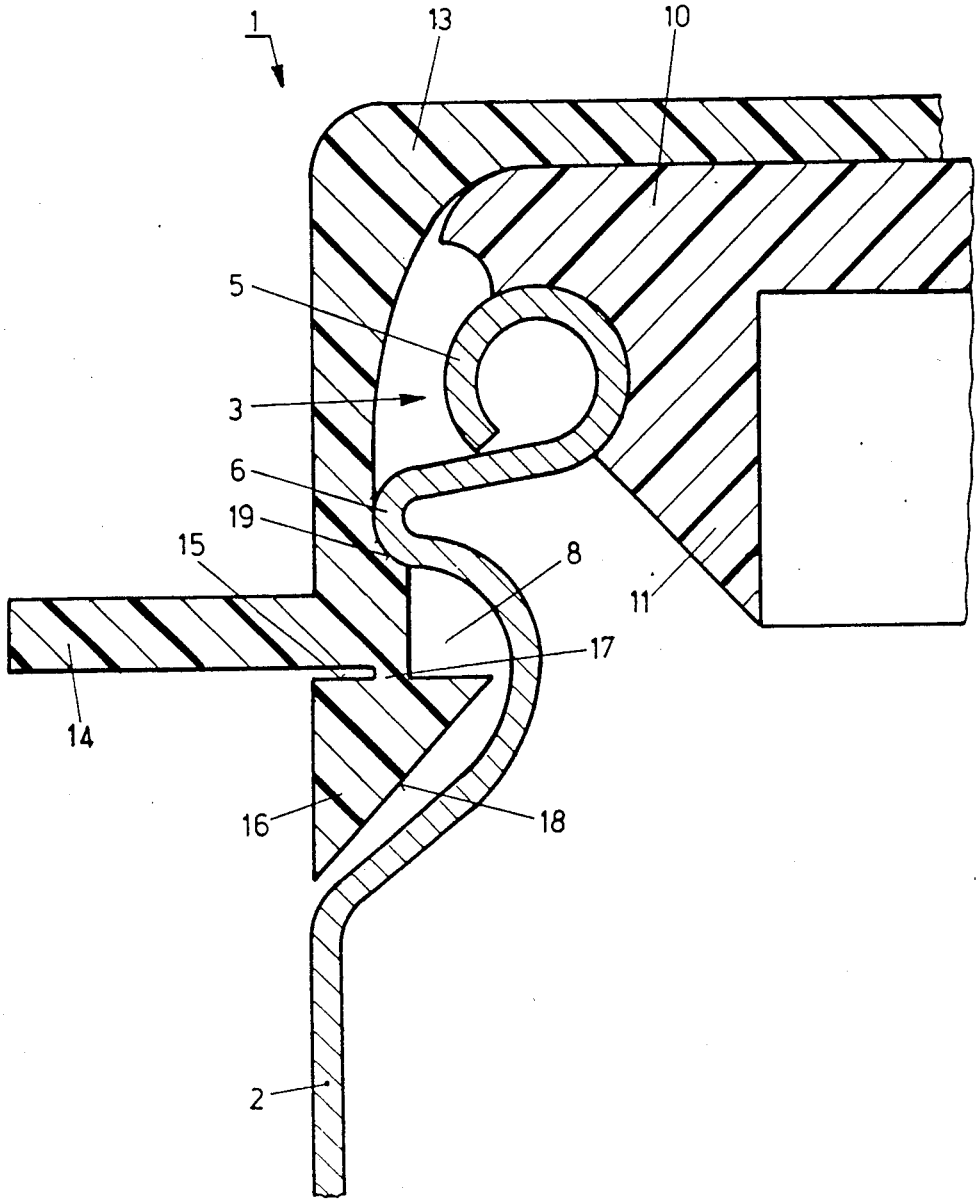
FIG. 1 is a cross-sectional view taken through the upper part of a shaker type container provided with a security closure lid thereon.
Figure 2:
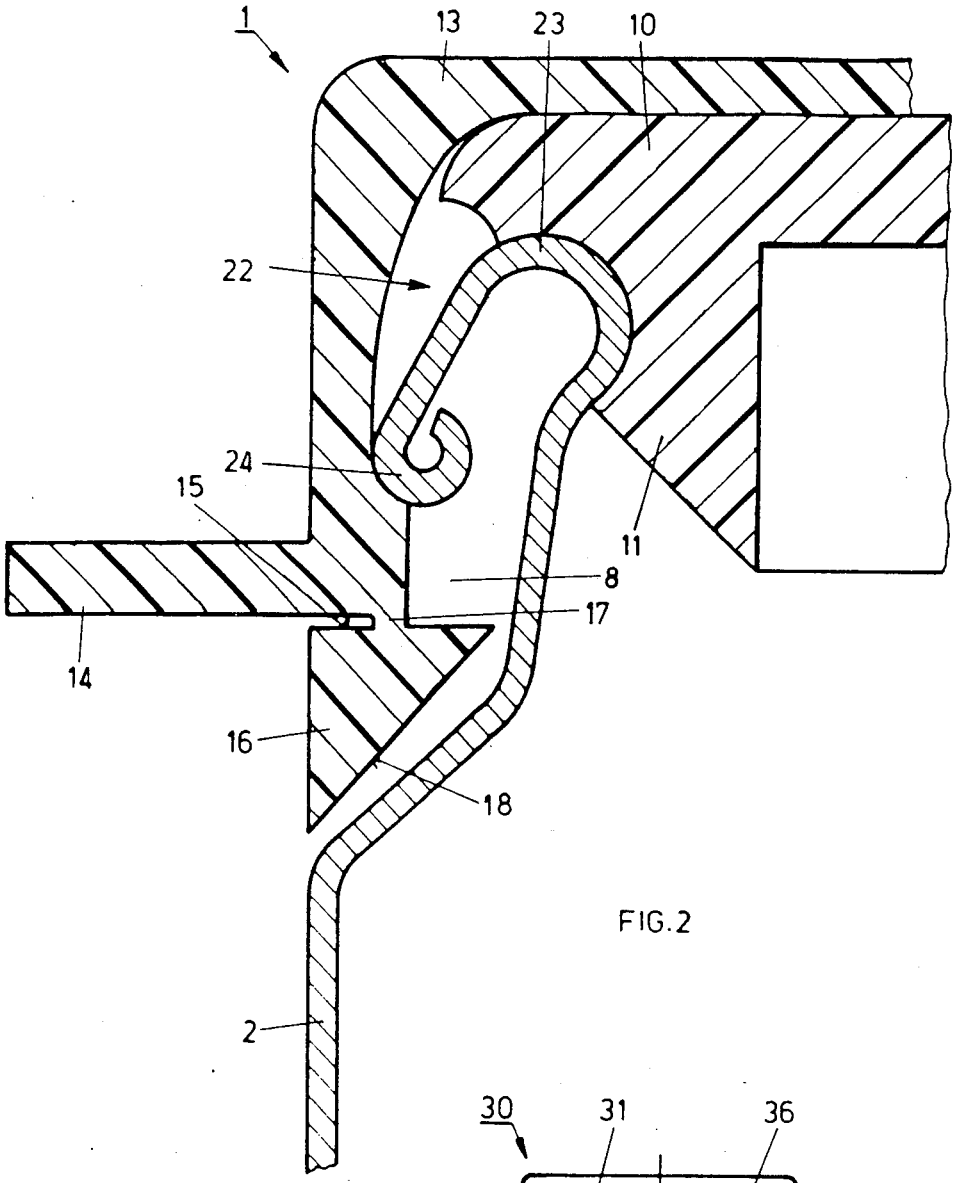
FIG. 2 is a view of a container similar to that of FIG. 1 showing an alternate embodiment of the container rim.

Referring now to FIGS. 1 and 2, there is shown similarly configured shaker type containers having a security closure lid thereon and which are preferably made of plastic. Shown in an upper part 1 of an exemplary shaker type container having a container body 2 and a rim region 3. The upper edge of container body 2 is formed by an upper closure edge bead 5. Adjacent to upper closure edge bead 5 is circumferential locking bead 6 which protrudes laterally from container body 2. Indentation 8 is provided between locking bead 6 and the cylindrical part of container body 2 and overall forms a generally serpentine shaped upper edge.

Onto upper closure edge bead 5 there is pressed a perforated member 10 which is preferably made of plastic. This therefore allows contents in the container (not shown) such as spices or the like to exit, via shaking, therefrom. Perforated member 10 has a locking edge 11 which after being pressed onto container 2 surrounds closure edge bead 5 and holds the member fast to container body 2 so that it does not come off during shaking of the container.

Container 2 is closed by lid 13 having a lid rim 14 which may protrude to a greater or lesser extent than that shown. Below lid 14 there is a security closure band 16 which, via connecting neck 17, is integral with lid 13. Lid 14 is preferably made of plastic. Closure band 16 lies annularly within indentation 8. The closure band 16 has a tear tab (not shown) which is used to separate band 16, at connecting neck 17, from lid rim 14 or lid 13. The closure band 16 is preferably of triangular cross-section and has a run-on or ramp entrance surface 18 as well as a free surface 15 radially outward of neck 17 and another free surface radially inward of neck 17 the inner edge of band 16.

After container body 2 has been filled, screen member 10 is preferably pressed by machine over upper closure edge bead 5 into the position shown in FIG. 1. Screen member 10 is now held fast by locking edge 11. Preferably during the same operation, lid 13 is pushed onto region 3 of the rim of container body 2. Upon this movement, run-on or ramp surface 18 is caused to lie against circumferential locking bead 6. Upon further pushing of lid 13 onto container body 2, security closure band 16 is swung, in a counterclockwise direction with elastic connecting neck 17 acting as a pivot area. In this way, closure band 16 moves partially into indentation 8 in which, after further placement of lid 13 onto container body 2, it will again swing back into the locking position as shown in FIG. 1.

In order to also hold lid 13 substantially free of clearance on edge region 3, inner lid lock 19 engages behind circumferential locking bead 6. In this manner, it is possible to place lid 13, together with perforated member 10, simultaneously onto container body 2 in a single operation. Therefore, a secure or tamper-proof seal is formed by means of security closure band 16.

Subsequent lifting of lid 13 without removal of the security closure band 16 is thus made impossible. The reason for this is that the inner edge radially inward of neck 17 of closure band 16 will impinge upon locking bead 6 and thereby prevent removal of lid 13 unless and until closure band 16 is deformed and/or removed from the remainder of lid 13.

Referring now specifically to FIG. 2, it can be seen that region 22 of the edge of container body 2 is somewhat differently shaped than the embodiment of FIG. 1. Here, upper closure edge bead 23 is extended toward the wall of container body 2 so as to form locking bead 24. However, it should be understood that functionally, placement of perforated member 10 and lid 13 in the embodiment as shown in FIG. 2, is substantially the same as described with respect to FIG. 1.

Figure 3:
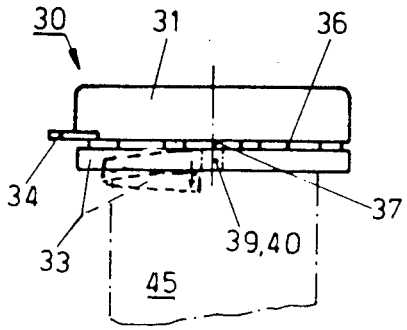
FIG. 3 is a side view of another alternate embodiment of the security closure structure of the present invention which has been placed onto a container.
Figure 4:
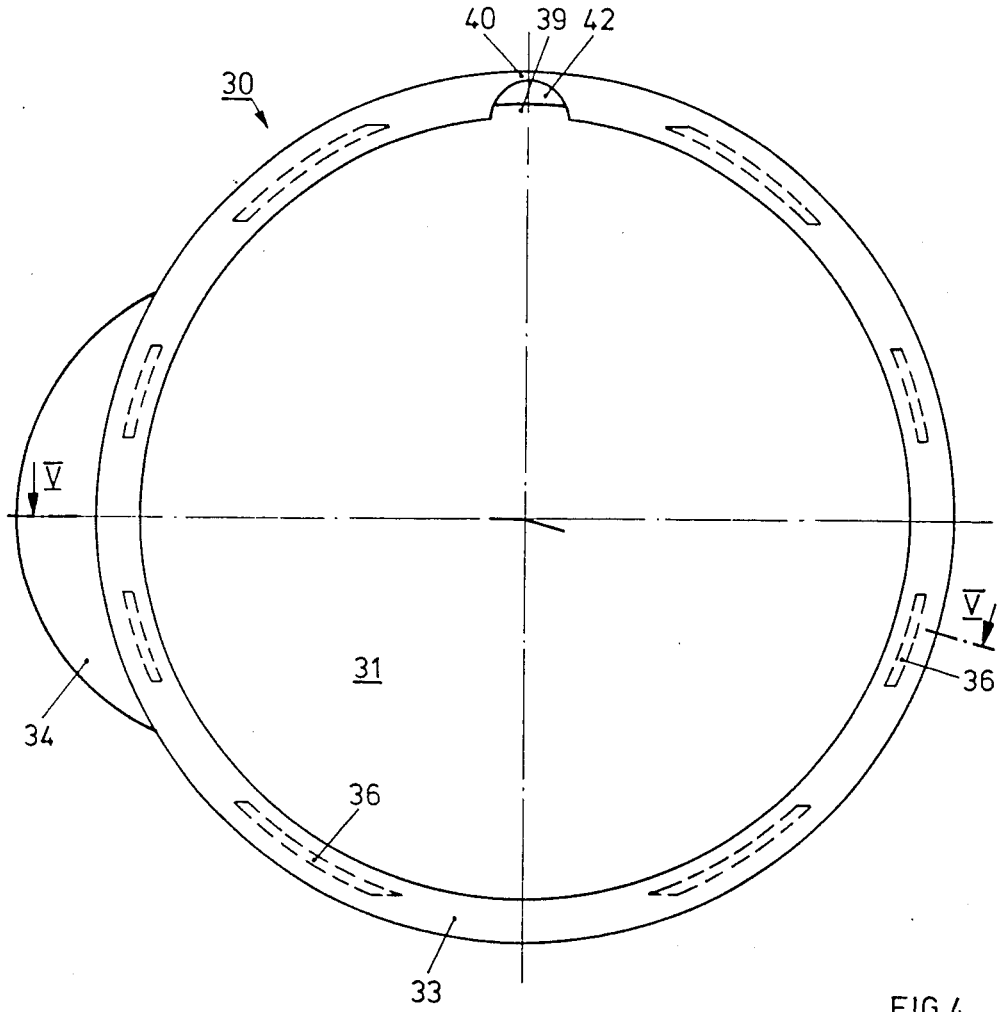
FIG. 4 is a plan view of the security closure lid of FIG. 3.
Figure 5:
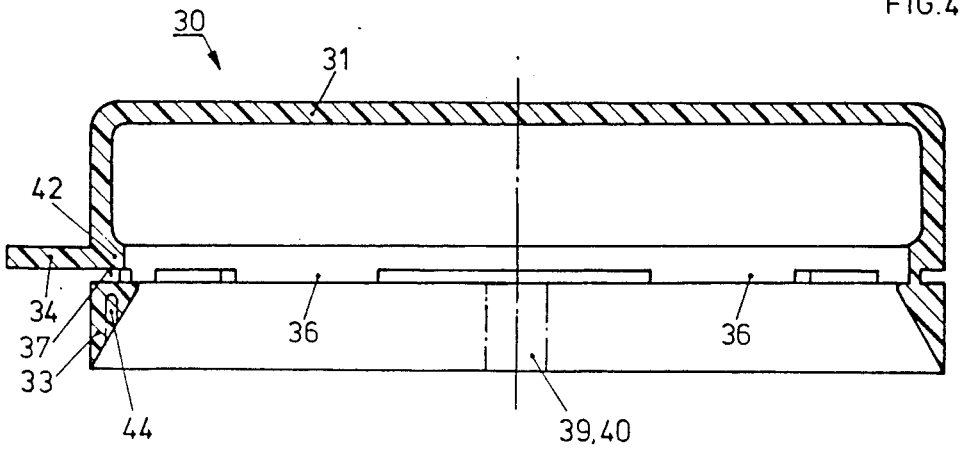
FIG. 5 is a sectional view taken through the lid of FIG. 4 along section line V—V.

Referring now to FIGS. 3, 4 and 5, an alternate embodiment of the security closure lid may be seen. However, it is to be understood that many of the features are similar and need not be described again.

Also, upper part 45 of the container in FIG. 3 has been shown using a dashed line in order to aid in understanding of the invention. The essential concept of this alternate embodiment is in the provision for at least one weakened portion in the security closure band. Therefore, in the event of partial separation of lid part 31 from security closure 33, it will become immediately obvious that tampering or the like has occurred. This will therefore prohibit access to the inside of the container without a visible indication thereof.

The lid 31 is connected by connecting arms 36 to security closure band 33. An annular stop surface 37 on lid part 31 acts as a limitation to the extent which security closure band 33 may swing out. Therefore, once lid part 31 has been placed onto the container, it may not be lifted off without at least partial detachment of the connection between lid part 31 and security closure band 33. This is done by causing at least partial separation at connecting arms 36, thereby indicating a tampered or adulterated container.

Lid part 31 is provided with lid part holding rim 42 which engages the corresponding edge of the container and thus secures lid part 31 in the closed position, even after opening of the security closure.

As may be seen in FIG. 4, security closure band 33 is provided with a notch or groove 39 which thereby establishes a weakened or breakaway portion 40 extending transverse of the circumference thereof, within security closure band 33. It is to be understood that it is possible to provide two or more weakened portions 40, thereby assuring a relatively loose connection between corresponding parts of the band. Therefore, upon tearing of the connection between lid part 31 and security closure band 33, the corresponding part of the security closure band 33, as shown in the dashed line in FIG. 3 will, due to deformation of weakened portion 40, hang down under its own weight. Therefore, a gap which is immediately and readily observable by the consumer or any other interested party, is produced between lid part 31 and security closure band 33. The above-mentioned notch or groove 39 (which establishes the weakened or breakaway portion 40) serves to allow the security band 33 or tear at the notch 39 when the lid part 31 is grasped by its tear tab 34 and pulled up and away from the container body 2. FIG. 4 shows that the notch 39 in the security band 33 is circumferentially spaced away from the tear tab 34 of the lid cover 31 and that several of the connecting arms 36 (which hold the lid 31 and the security band 33 connected to one another) are located between the tear tab 34 and the notch 39 and that the remaining connecting arms 36 are located further away from the notch 39 and the tear tab 34.

The above described structure of the invention results in the tearing of the security band 33 at the notch 39 and the hanging down of at least a portion of the security band 33 to alert a consumer that the container 2 has been tampered with, when the lid cover is partially or fully opened. This result occurs as follows. The initial lifting of the tear tab 34 stretches and breaks the connecting arms 36 between the tear tab 34 and the notch 39 because the security band 33 is restrained by the lid rim 14 of container body 2. However, further lifting of the lid 31 creates a shearing force which breaks the band 33 at the notch 39 because, as is clearly evident from FIG. 4, the connecting arms 36 are larger and sturdier than the weakened portion 40 at the notch 39 of security band 33. The portion of security band 33 nearer the tear tab 34 then hangs down to provide a highly visible and positive indication of tampering.

As an example of the use of more than one weakened portion 40, it is contemplated that it is possible to arrange at least two weakened portions symmetrically with respect to tear tab 34 and one portion 40 in the center thereof.

Further, security closure band 33, having an approximately triangular cross-section depending upon material selection, may be provided with an annular slot 44, thereby assuring easier deformation.

Accordingly, it is possible with the present embodiments to effect easy application of a lid to a container in an automated continuous process while rendering the contents of the container inaccessible without visual evidence of tampering or the like.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. In combination, a container and a security lid for the container, comprising:

the container having an open mouth for being closed by the lid, the container mouth having surrounding it a locking bead for being engaged by the lid;

the lid being placeable over the container mouth for blocking access into the container through the mouth; the lid including a periphery around the container; a security strip around the periphery of the lid for being disposed beneath the locking bead at the mouth of the container with the lid in place over the mouth for holding the lid over the container mouth;

the security strip being attached to the periphery of the lid; a tear tab on the lid for being grasped; the strip being arranged so that lifting the tear tabs peels the security strip away from the lid to at least partially separate the security strip from the lid;

at least one weakened area in the security strip extending transversely of the circumference of the security strip; the at least one weakened area being circumferentially spaced away from the tear tab;

the security strip being held to the lid such that raising the tear tab to separate the lid from the security strip up to the weakened area breaks the security strip at the weakened area for providing an indication of an incomplete attempt to remove the security strip from the lid.

2. The combination of claim 1, wherein the weakened area comprises an area of decreased thickness of the security strip, as compared with the thickness of the remainder of the security strip.

3. The combination of claim 1, wherein the security strip has an upwardly facing surface which faces up toward the lid and which is so placed that with the lid disposed over the mouth of the container, the security strip is disposed beneath the locking bead of the container; the security strip is configured for abutting the locking bead and preventing removal of the lid from the container until the tear tab has torn the lid away from the security strip.

4. The combination of claim 3, comprising means connecting the security strip to the lid for permitting the security strip to pivot slightly with respect to the lid for enabling the security strip to pass over the locking bead at the mouth of the container as the lid is applied to the container.

5. The combination of claim 1, wherein the weakened area comprises a region of the security strip which is thinned transversely to the circumference of the security strip, reducing the strength of the security strip at the weakened area, whereby the security strip might break at the weakened area for indicating that the security strip has been partly separated from the lid.

6. In combination, a container and a lid for the container;

the container having an open mouth and having an annular locking bead around the open mouth;

the lid being shaped for closing the open mouth;

the lid having a peripheral edge; a security strip attached at the peripheral edge, the strip being shaped for passing over the locking bead at the mouth of the container when the lid is applied to the container and for engaging beneath the locking bead for preventing removal of the lid from the container;

the security strip being connected to the lid through a reduced thickness neck which is thinner than both the lid and the security strip which the neck joins; the security strip having an outward surface which is radially outward of the container and of the neck of the security strip and is placed for abutting the edge of the lid if the security strip is attempted to be pivoted outwardly from the container around the neck; the security strip having an inward surface which is radially inward of the neck and which is shaped for contacting the locking bead around the container when it is attempted to raise the lid from the container, which attempts to pivot the security strip outwardly and brings the outward surface of the security strip into abutment against the peripheral edge of the lid for preventing such pivoting of the security strip; the security strip further including an entrance surface which is both downwardly and radially outwardly inclined at the underside of the security strip for engaging the locking bead upon the lid being applied to the container, and such engagement urges both the security strip and the attached lid outwardly temporarily for enabling the security strip to pass the locking bead enabling the lid to be applied to the container.

7. The combination of claim 6, wherein the neck is so placed and the entrance surface of the security strip is so shaped that the security strip is pivotable inwardly toward the container, in the direction separating the outward surface of the security strip from the edge of the lid upon installation of the lid to the container, while the outward surface of the security strip and the edge of the lid are so shaped and positioned as to prevent outward pivoting of the security strip upon the locking bead contacting the inwardly projecting surface of the security strip upon attempted removal of the lid from the container.

8. The combination of claim 6, further comprising a tear tab on the lid for being grasped; the strip being arranged so that lifting the tear tab peels the security strip away from the lid and breaks the connection between the security strip and the lid at the reduced thickness neck to at least partially separate the security strip from the lid;

at least one weakened area in the security strip and extending transversely of the circumference of the security strip; the weakened area being along the security strip from the tear tab;

the security strip being held to the lid such that raising the tear tab to separate the lid from the security strip up to the weakened area breaks the security strip at the weakened area for providing an indication of an incomplete attempt to remove the security strip from the lid.

9. The combination of claim 8, wherein the neck is so placed and the entrance surface of the security strip is so shaped that the security strip is so shaped that the security strip is pivotable inwardly toward the container, in the direction separating the outward surface of the security strip from the edge of the lid upon installation of the lid to the container, while the outward surface of the security strip and the edge of the lid are so shaped and positioned as to prevent outward pivoting of the security strip upon the locking head contacting the inwardly projecting surface of the security strip upon attempted removal of the lid from the container.

10. The combination of claim 8, wherein the weakened area comprises an area of decreased thickness of the security strip, as compared with the thickness of the remainder of the security strip.

11. The combination of claim 8, wherein the weakened area comprises a region of the security strip which is thinned transversely to the circumference of the security strip, reducing the strength of the security strip at the weakened area, whereby the security strip might break at the weakened are for indicating that the security strip has been partly separated from the lid.

* * * * *